United States Patent [19]

Meacham

[11] 4,139,941

[45] Feb. 20, 1979

[54] WINDOW SHADE CUTTER

[75] Inventor: George B. Meacham, Cohasset, Mass.

[73] Assignee: Clopay Corporation, Cincinnati, Ohio

[21] Appl. No.: 835,486

[22] Filed: Sep. 22, 1977

[51] Int. Cl.[2] ..... B26D 1/26; B26D 3/16

[52] U.S. Cl. ..... 30/123; 30/96; 82/78

[58] Field of Search ..... 30/123–125, 30/92–96, 289, 329, 115, 282, 296 R; 82/70.2, 78

[56] References Cited

U.S. PATENT DOCUMENTS

| | | | |
|---|---|---|---|
| 770,131 | 9/1904 | Tufts | 82/78 |
| 823,796 | 6/1906 | Leyes | 30/95 |
| 2,615,516 | 10/1952 | Hyde | 30/93 |
| 3,305,925 | 2/1967 | Middleton, Jr. | 30/92 |
| 3,636,629 | 1/1972 | Baun | 30/94 |
| 3,798,765 | 3/1974 | Mattsson | 30/96 |

*Primary Examiner*—Leonidas Vlachos

*Attorney, Agent, or Firm*—Wood, Herron & Evans

[57] ABSTRACT

This invention is directed to a window shade cutter for manually trimming the end of a rolled shade to conform to the size of the window opening into which the shade is to be mounted. The cutter includes a cylindrical clamping sleeve, having an annular guide groove at one end thereof, adapted to slip over the shade and clamp in place and a cutoff tool receivable in the guide groove including a generally planar U-shaped holder and a planar blade mounted on the holder. In a preferred form, the blade has a rounded, dull end with a central V-shaped notch therein in which a pair of cutting edges are located. The cutoff tool is adapted to interlock in the guide groove and to rotate about the shade with cutting of the shade taking place in the V-shaped notch a few layers at a time as the tool is urged towards the shade and rotated. In accordance with the invention disclosed, window shades can be safely and easily trimmed by the consumer in the home thus eliminating the need for cutting machines.

8 Claims, 7 Drawing Figures

WINDOW SHADE CUTTER

BACKGROUND OF THE INVENTION

This invention relates to a window shade cutter and, more particularly, to a cutter for manually trimming the end of a shade to length.

The number of sizes of window openings into which window shades must be fitted is limited. Practically, all shades will be in the range of 25 to 72 inches in roller length, but there are window openings for every dimension within that range, and in older houses, the window openings are frequently less than 25 inches wide. In the application of shades to windows, the shades must conform to the window size rather than the window size conforming to the available size of shades manufactured. This is true not only for newly constructed buildings, but obviously also for those buildings which were erected many years ago. For these reasons, when a customer wants a shade, it is common practice to select an oversized shade and cut its length to conform to the size of the window opening into which the shade is to be mounted.

One type of window shade now being manufactured includes two sections, one being telescopable into the other, for supporting the shade material so that sizing of the shade can be effected merely by cutting the shade material and the slat running through the lower hem, sliding the cut material from the roller, and telescoping the projecting portion of the roller into its adjoining section. Window shades of this type are described and disclosed in U.S. Pat. Nos. 3,203,468; 3,299,944; and 3,580,323, all assigned to the assignee of this invention.

A principal outlet for shades of this type and the place in which much of the cutting to size is performed is the variety, discount, or department store. The difficulty in achieving a smooth, even and well-trimmed shade edge virtually requires that the cutting to size be performed on a conventional retail outlet shade cutting machine. The cutting of a shade to size in such establishments is at best an annoying undertaking. For example, the operation requires first measuring the length of the shade to conform the length to the premeasured size of the window opening to determine the point at which the shade is to be trimmed, mounting the rolled shade in the cutting machine, aligning the cutoff blade with the measured trim line, starting the machine to rotate the shade, urging the cutoff blade towards the shade until the shade material is cut completely through and the roller is reached, stopping the machine, removing the trimmed shade material, and removing the trimmed shade from the machine. Even with the machine, however, the trimming of window shades for the customer is regarded as a disagreeable and time-consuming task. Because of the number and difficulty of steps required to size the shade, it is not customary for this operation to be performed by the consumer in the home.

SUMMARY OF THE INVENTION

This invention consists of a unique article for the trimming of window shades to conform to window openings of various sizes which may be easily and safely operated by the consumer in the home thereby eliminating need for cutting machines. The invention provides a cut comparable to that obtained from retail outlet shade cutting machines but is simple in design, contains a minimum of parts, may be inexpensively manufactured and is very easily operated thus overcoming a number of problems heretofore associated with prior art window shade cutters. In accordance with the principles of the invention, the window shade cutter includes two assemblies, a clamping sleeve having an annular guide groove at one end thereof which slips over the rolled-up shade and clamps in place and a shade cutoff tool which rotates in and is guided by the annular guide groove and which carries a blade which can be manually urged into the rolled-up shade material. In one presently preferred form of the invention, the cutoff tool includes a generally planar U-shaped holder having a pair of tines which interlock in the guide groove and a planar blade mounted on the holder in spaced relation to the tines such that rotation of the blade about the rolled shade is essentially wobble-free thereby providing a smooth, even shade edge after cutting.

Trimming of the shade is accomplished by manually forcing the holder and blade into the surface of the rolled-up shade and simultaneously rotating the tool around the shade. A few layers of shade material are cut in each revolution and the operation continues until the blade passes through all the layers of shade material and contacts the shade roller. At this point, the excess material is unwound and slipped off the roller and the roller is telescoped to the proper length. The cutter is then removed from the shade, and the window shade is mounted in the window opening.

In the general aspect, this invention provides a window shade cutter for use by the consumer in the home which gives a cut comparable to that obtained from retail outlet shade cutting machines. The cutter is simple in design and employs a minimum of parts and is inexpensive to manufacture so that it can be sold with an individual shade and then discarded after use. Furthermore, the cutter is easy to operate and is safe such that the danger of injury to the user is minimized.

In one presently preferred form of the invention, the blade mounted on the holder has a dull, generally rounded end with a central V-shaped notch in the end. A pair of intersecting sharp cutting edges are located in the notch. The blade is bidirectional so that cutting of the shade material by rotation of the blade in either direction is possible. Further the sharp cutting edges are recessed in the central notch and the rest of the blade is dull to assure user safety. The radius at the end of the blade prevents the blade corners from snagging or ripping the shade film layers and the plane of the blade is substantially perpendicular to the longitudinal axis of the shade such that cutting of the shade is accomplished by manually urging the holder and blade towards the shade and rotating it about the shade with the blade cutting a few shade layers at a time in the notch.

The window shade cutter of the present invention thus allows the consumer to cut the shade in his home to fit the window opening rather than having a retailer cut it to the consumer's measurement. The consumer thus does not have to premeasure his windows before purchase, making impulse purchases possible. The retailer does not have to keep a shade cutting machine and a qualified operator in the store to serve his shade customers. This factor expands the number of potential retail outlets as well as eliminates the cost to the retailer of owning and maintaining a machine and employing a qualified operator. Further, the present invention permits the customer to determine the shade cut location directly by holding the shade up to the window opening. This direct measurement minimizes the possibility of inadvertently cutting the wrong shade length because of an incorrect customer measurement or cutting error by the retailer. Thus, the retailer need not be concerned with return of shades because of cutting errors.

This invention is thus in contrast with prior art window shade cutters. Known cutters, e.g., that shown in U.S. Pat. No. 2,615,516, typically include numerous individual parts and are unduly complicated and expensive to manufacture. Furthermore, such cutters employ blades having at least one exposed sharp cutting edge. Such cutters are expensive to manufacture, are difficult to operate and are characterized by very low safety factors. For these reasons, they have not found commercial acceptability.

In summary, the window shade cutter of the present invention overcomes the disadvantages associated with known cutters and permits sizing of the shade by the consumer in the home thereby eliminating the need for retail outlet shade cutting machines while yielding a cut equal in quality to that of such machines. These and other advantages of the invention will be further appreciated by reference to the following detailed description and accompanying drawings.

DETAILED DESCRIPTION OF THE INVENTION

Figure 1:
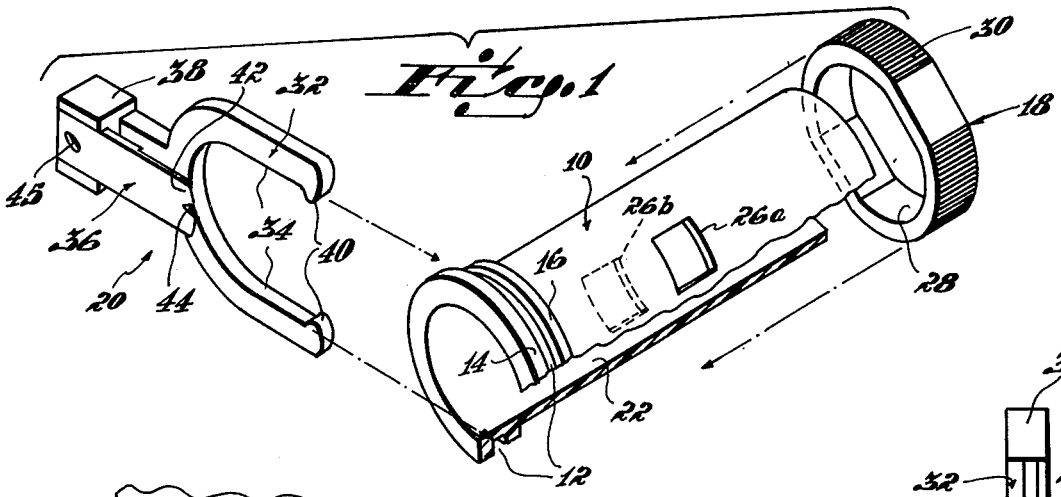
FIG. 1 is a perspective view of the invention with parts in section.
Figure 3:
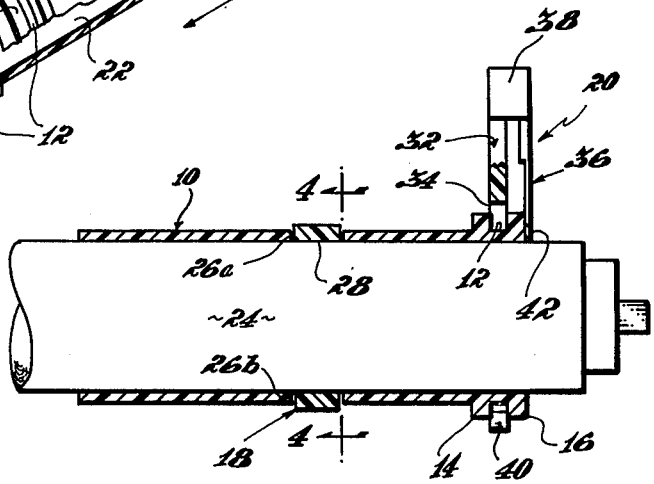
FIG. 3 is a longitudinal cross-sectional view of the invention as received on a rolled window shade with the tool holder interlocked in the guide groove.

Referring to FIG. 1, the window shade cutter includes a cylindrical clamping sleeve 10 having an annular guide groove 12 at one end thereof formed by spaced annular flanges 14 and 16, a clamp ring 18 receivable about the clamping sleeve 10, and a cutoff tool 20 receivable in the guide groove 12. The clamping sleeve 10 is formed of a flexible material such as plastic or paperboard and has an internal bore 22 having a diameter permitting the sleeve to freely slip over the rolled-up shade 24 (FIG. 3). Two opposed windows *26a, 26b* are formed in the wall of the sleeve 10. The clamp ring 18 has a generally oval through opening 28 and is slightly shorter than the length of the windows *26a, 26b*. The major dimension of the oval 28 is greater than the sleeve diameter and the minor dimension is less, and the oval ring's inside circumference is slightly greater than the sleeve's outside circumference to allow the ring 18 to be forced over the sleeve 10 during assembly. The clamp ring 18 further includes a gripping area 30 formed by serrating portions of its outer surface to make twisting of the ring easier.

Figure 4:
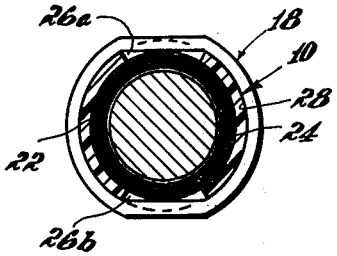
FIG. 4 is a cross-sectional view taken along line 4—4 of FIG. 3 showing the clamp ring in the unclamped position.
Figure 5:
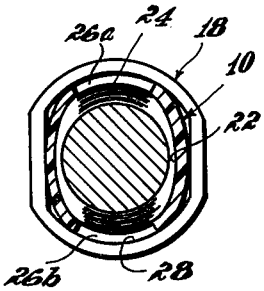
FIG. 5 is a view similar to FIG. 4 with the sleeve clamp ring rotated 90° showing the clamp ring in the clamped position.

Referring in addition to FIGS. 3–5, the clamping sleeve 10 is adapted to slip over the end of the rolled window shade 24 and when located at the proper longitudinal position on the shade to clamp in place to prevent longitudinal movement of the guide groove with respect to the shade during the cutting operation. Thereafter, the sleeve is unclamped and removed from the shade. This is accomplished in accordance with the embodiment shown in FIG. 1 by locking and unlocking of the clamp ring 18. In the unclamped position (FIG. 4), the clamp ring 18 nests in the sleeve windows *26a, 26b* and the bore 22 of the sleeve 10 is round and unobstructed so that the window shade can be slipped through. When the ring 18 is rotated 90° into the clamped position (FIG. 5), the sleeve 10 is deformed by the ring 18 and clamps against the shade 24 thereby locking the sleeve in place. The flanged sleeve 10 is thereby secured so that it provides a stationary and accurate guide for the shade cutoff tool 20. After the shade cutting operation, the ring is rotated to its unclamped position and the sleeve and shade cutter are removed from the shade. The longitudinal location of the clamping force, i.e., the location of the clamp ring 18, is removed from the point at which the shade is being cut. This prevents distorting or wrinkling of the rolled shade material in the cutting zone which could otherwise cause an uneven cut.

The cutoff tool 20 includes a generally planar U-shaped holder 32 having a pair of tines 34 which interlock in the guide groove 12, a blade 36, and a spacer 38 between the holder 32 and the blade 36. The tines 34 are of a thickness substantially the same as the width of the guide groove 12 such that as when the holder 32 is received in the guide groove 12, the tines 34 interlock with the groove 12, and the tool 20 may be rotated thereabout without wobbling thereby preventing the formation of "whiskers" on the shade edge being cut caused by multiple passes over the same layer of material at different longitudinal positions. The tines 34 further include inwardly directed detents 40 to prevent accidental removing of the holder 20 from the guide groove 12. That is, the holder 20 is formed of a flexible material such as a plastic such that the tines flex outwardly as the holder is inserted in the guide groove by the act of forcing the sleeve 10 between the detents 40 and then spring back to be held in the groove by the detents 40.

Figure 2:
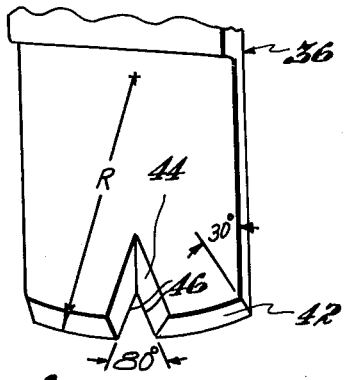
FIG. 2 is a perspective view of the cutter blade end.

An important aspect of the present invention is the configuration of the blade 36. In the presently preferred form as shown in FIG. 2, the cutting end 42 of the blade 36 is rounded and includes a centrally located, symmetrical V-shaped notch 44. The end 42 of the blade is dull so that the blade is safe to handle and accidental injury to the consumer is avoided. A pair of sharp cutting edges 46 are located inside the notch 44 lying on intersecting axes. The cutting thus takes place in the notch 44 a few layers at a time as the blade and holder are urged towards the shade. The depth of the cut is a function of the pressure applied by the user. The blade and notch 44 are symmetrical and thus cut equally well regardless of the direction of rotation.

The blade 36 is mounted on the holder 32 by means of the spacer 38 and securing means such as a rivet 45 passing through the end of the holder and the interposed spacer 38. The dimensions of the spacer are such that with the holder interlocked in the guide groove the blade is accurately located in the proper cutting position which may be determined merely by placing the window shade and cutter assembly in the window opening.

As stated above, the configuration of the blade is an important aspect of the present invention. In the preferred form of the blade, the angle of the notch 44 is approximately 80° and the rounded end 42 is chamfered at an angle of approximately 30°. The radius R of the rounded end 42 is approximately 0.4 inches. The end of the blade is made thin; that is, on the order of approximately 0.015 inches in thickness to permit easy penetration of the blade while the remainder of the blade is made thicker, i.e., on the order of 0.025 inches in thickness to provide the blade with structural strength. The blade may be made from hardened spring steel or the equivalent.

Figure 6:
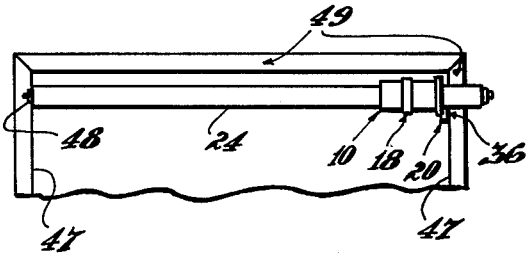
FIG. 6 is a schematic illustration showing the invention as received on a shade and the shade placed in a window opening for sizing of the shade to length.

Referring now to FIG. 3, the operation of the present invention will be described. With the cutoff tool 20 interlocked in the guide groove 12, the sleeve 10 is slipped over the end of the rolled-up shade 24. The opening in the cutoff tool between the tines is shaped to allow the tool and blade to move radially towards and away from the surface of the rolled-up shade material. With the clamp ring in the unclamped position, the shade and cutter assembly are placed in the window opening 47 with the pin end 48 of the shade 24 mounted in its fixture. The sleeve is then adjusted to its position conforming to the window opening 47 by sliding the sleeve along the shade until the blade 36 and spacer 38 contact the window frame 49 (FIG. 6). The clamp ring 18 is then twisted to lock the sleeve 10 in place on the shade. When the blade handle is against the frame on the one end with the other end of the shade in its mounting bracket 48, the sleeve is correctly positioned. It may thus be seen that no physical measurement of the length of the shade for trimming need be made.

The shade with the shade cutter clamped in position is removed from the window opening and the cutting operation performed by pushing the cutoff tool radially toward the shade while rotating the tool about the shade. The cutoff blade 36 is thrust into the shade material with cutting of the shade material proceeding a few layers at a time within the notch 44. Rotation with accompanying radially inward movement of the holder proceeds until the blade contacts the telescoping roller member all the way around. The trimmed shade material is then pulled off and, as a last step, the clamp ring is unclamped and the cutter removed from the shade. The cutter may then be simply discarded. The roller sections are telescoped to conform to the window opening.

Figure 7:
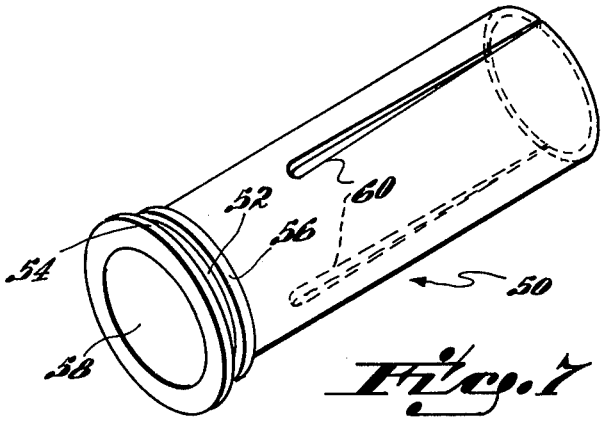
FIG. 7 is a perspective view of another form of clamping sleeve.

Referring now to FIG. 7, there is shown another embodiment of a sleeve for locating the blade along the shade and clamping on the shade. In this embodiment, a split sleeve 50 includes a guide groove 52 formed again by spaced flanges 54 and 56 and a longitudinal bore 58 through which the rolled window shade may pass. The sleeve is again formed of a flexible material such as plastic or paperboard. The sleeve 50 includes a pair of longitudinal slits 60 in the wall thereof which permits the inner diameter of the sleeve to expand as the rolled window shade is passed through the bore 58 after which the sleeve wall springs back to tightly clamp the sleeve in position on the shade. Again, it may be seen that the clamping force is removed from the cutting area at the grooved end of the shade to prevent wrinkling or distortion of the shade material in the cutting area.

Having described this invention in its presently contemplated best mode, it will be apparent to those of ordinary skill that obvious variations may be made in view of the above description to obtain the benefits thereof.

I claim:

1. A hand tool for cutting a rolled window shade comprising a sleeve adapted to slip over the rolled shade having an annular guide means at one end thereof, means for clamping said sleeve in place on the shade, and a cutoff tool receivable in said guide means comprising a holder having means interlocking with said guide means and having cutter means, said cutter means having a dull exposed end and at least one cutting edge, said edge being recessed in said end, for cutting said shade, the plane of said cutter means being substantially perpendicular to the longitudinal axis of said shade, said tool being adapted to be manually urged toward said shade and rotated thereabout.

2. Claim 1 wherein said holder is a generally planar U-shaped holder and wherein said means interlocking with said guide means comprises a pair of tines.

3. Claim 1 wherein said cutoff tool further includes a spacer between said cutter means and said holder, the dimensions of said spacer being such that when said holder is interlocked with said guide means said cutter means is thereby positioned for cutting of the shade.

4. Claim 1 wherein said annular guide means comprises a guide groove formed by spaced annular flanges on said sleeve.

5. Claim 1 wherein said means for clamping said shade in place comprises a clamp ring having a generally oval through opening, said ring being adapted to be rotated from an unclamped position wherein said sleeve freely slides on said shade and a clamped position wherein said ring compresses said sleeve into engagement with said shade.

6. A hand tool for trimming the end of a rolled window shade comprising a cylindrical sleeve adapted to slip over the rolled shade having an annular guide means at one end thereof, means for clamping said sleeve in place on the shade, and a cutoff tool receivable in said guide groove, said tool comprising a generally planar U-shaped holder having a pair of tines interlocking with said guide means, a substantially planar blade mounted on said holder, and a spacer therebetween, said blade having a dull, generally rounded end, a central V-shaped notch in said end, and a pair of intersecting cutting edges in said notch, the plane of said blade being substantially perpendicular to the longitudinal axis of said shade, said tool being manually radially movable in said guide means to bring said cutting edges into engagement with said shade and rotatable about said shade such that cutting of said shade takes place in said notch as said tool is rotated.

7. Claim 6 wherein the angle of said V-shaped notch is about 80°.

8. Claim 7 wherein said rounded end of said blade has a thickness of about 0.015 inches and a chamfer at an angle of about 30°.

* * * * *

UNITED STATES PATENT AND TRADEMARK OFFICE

CERTIFICATE OF CORRECTION

PATENT NO. : 4,139,941

DATED : February 20, 1979

INVENTOR(S) : George B. Meacham

It is certified that error appears in the above-identified patent and that said Letters Patent are hereby corrected as shown below:

Column 1, line 9, "limited" should be --limitless--

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*